US009730501B2

(12) United States Patent
Diezinger

(10) Patent No.: US 9,730,501 B2
(45) Date of Patent: Aug. 15, 2017

(54) FLUID APPLICATION DEVICE

(76) Inventor: Thomas Eugene Joseph Diezinger, Boulogne Billancourt (FR)

( * ) Notice: Subject to any disclaimer, the term of this patent is extended or adjusted under 35 U.S.C. 154(b) by 950 days.

(21) Appl. No.: 13/513,266

(22) PCT Filed: Nov. 23, 2010

(86) PCT No.: PCT/FR2010/052488

§ 371 (c)(1),
(2), (4) Date: Jun. 1, 2012

(87) PCT Pub. No.: WO2011/067500

PCT Pub. Date: Jun. 9, 2011

(65) Prior Publication Data

US 2012/0238926 A1 Sep. 20, 2012

(30) Foreign Application Priority Data

Dec. 2, 2009 (FR) ..... 09 05843
Feb. 22, 2010 (FR) ..... 10 51240

(51) Int. Cl.
*A61H 15/00* (2006.01)
*A45D 34/04* (2006.01)
*A61H 7/00* (2006.01)

(52) U.S. Cl.
CPC ..... *A45D 34/041* (2013.01); *A61H 7/00* (2013.01); *A61H 15/00* (2013.01); *A61H 2015/0064* (2013.01)

(58) Field of Classification Search
CPC ..... A45D 34/00; A45D 34/06; A45D 34/041; A45D 2034/002; A45D 2034/005; A61H 7/00
USPC ..... 601/17, 18, 19, 46, 84, 112, 113, 134, 601/135, 154; 401/208, 211, 212, 213, 401/215, 216
See application file for complete search history.

(56) References Cited

U.S. PATENT DOCUMENTS 2,654,108 A 10/1953 Scelsi
3,162,176 A * 12/1964 Dombrow ..... B43K 1/08 335/285
3,303,824 A 2/1967 Anderson
3,336,626 A 8/1967 Schaich
(Continued)

FOREIGN PATENT DOCUMENTS

AU 2004100934 A4 12/2004
FR 937657 A 8/1948
(Continued)

OTHER PUBLICATIONS

International Search Report issued Feb. 17, 2011 by European Patent Office re: PCT/FR2010/052488, pp. 3.

*Primary Examiner* — Quang D Thanh
(74) *Attorney, Agent, or Firm* — Osha Liang LLP

(57) ABSTRACT

A fluid application device and a device for storing and dispensing a fluid, as a massage device, includes: a holder including a cavity that has a visible depth for the cavity; at least one magnet contained within a recess that is present in the holder; and an application head including at least one portion made of a magnetizable material that is formed so as to be attracted by the magnet(s). The application head has an application surface higher than half the total outer surface of the application head, the device being arranged such that the application head is rotatably movable within the cavity.

27 Claims, 6 Drawing Sheets

(56) References Cited

U.S. PATENT DOCUMENTS

| | | | | |
|---|---|---|---|---|
| 3,376,551 | A | 4/1968 | Armbruster | |
| 4,037,977 | A * | 7/1977 | Ronai | A45D 33/12 601/131 |
| 4,940,350 | A | 7/1990 | Kim | |
| 5,725,473 | A | 3/1998 | Taylor | |
| 5,893,791 | A | 4/1999 | Wilkinson | |
| 6,102,875 | A * | 8/2000 | Jones | 601/113 |
| 2003/0040688 | A1* | 2/2003 | Bauer | 601/23 |
| 2004/0024336 | A1 | 2/2004 | Lin | |
| 2004/0131414 | A1 | 7/2004 | Delage | |
| 2005/0015030 | A1* | 1/2005 | Bousfield et al. | 601/113 |
| 2007/0014625 | A1 | 1/2007 | Delage | |
| 2011/0091265 | A1* | 4/2011 | Zhang | 401/195 |

FOREIGN PATENT DOCUMENTS

| | | | |
|---|---|---|---|
| FR | 2662424 | A1 | 11/1991 |
| GB | 635692 | A | 4/1950 |
| GB | 1515078 | A | 6/1978 |
| GB | 2413497 | A | 11/2005 |
| JP | 2009077878 | A | 4/2009 |

* cited by examiner

FLUID APPLICATION DEVICE

TECHNICAL FIELD

The present invention relates to a fluid application device.

The present invention also relates to a device for storing and distributing a fluid comprising an application device as well as a use of said application device or of said device for storing and distributing the fluid as a massage device.

BRIEF DISCUSSION OF RELATED ART

In application GB 635 692, an application device for a cosmetic fluid is proposed comprising a holder housing an application head in the form of a ball for distributing the fluid, said ball being retained by a magnet contained in the holder. This type of device has a fluid application surface limited to the surface of the ball that protrudes from the recess. The application surface offered by the ball, i.e. in contact with the user's skin, corresponds to the outer surface of the ball not opposite the holder. However, the holder is arranged so as to retain the ball in the recess, thereby having a small application surface.

Furthermore, given the small application surface, it is difficult for a user to grasp the ball to remove it from its recess.

BRIEF SUMMARY

One aim of the present invention is therefore to provide a fluid application device including an application head retained by a magnet allowing easy and reproducible removal of said head and which has a larger fluid application surface.

Another aim of the present invention is to provide a fluid application device including an application head having better rotation in the holder.

To that end, the present invention relates to a fluid application device including:

- a holder including a cavity that has a visible depth for the cavity;
- at least one magnet contained within a recess that is present in the holder;
- an application head including at least one portion made of a magnetizable material that is formed so as to be attracted by the magnet(s), said application head having an application surface higher than half the total outer surface of said head,
- the device being arranged such that said application head is rotatably movable within the cavity.

In the device according to the invention, the application head is retained only by the magnetic force exerted by the magnet(s) on said head. The various elements of the device according to the invention are then arranged so as to make it possible to offer a large application surface that is higher than half of the total surface of said head. In other words, the majority of the surface of the application head is able and configured to be used to apply fluid.

"Application surface of the application head" refers to the outer surface of the application head intended to be pressed against the user's skin and/or to apply a fluid on said skin.

The device according to the invention is arranged so as to allow better rotation of the application head in the cavity and thereby better use of said device.

Furthermore, due to the large application surface, a user can easily grasp the application head to remove it from the cavity housing the application head.

According to other features of the invention, the inventive device comprises one or more of the following optional features, considered alone or according to all possible combinations:

- the application head is at least one cylinder with a circular transverse section, and/or at least one element of revolution with a substantially oblong or circular shape;
- the application head is a ball having a radius larger than the visible depth of the cavity;
- the application head, in particular the ball, is solid or hollow;
- the application head assumes the form of a plastic or metal shell, in particular made from aluminum, containing a smaller metal element in the core thereof;
- the application head is a ball in the form of a plastic ball containing a magnetizable metal ball with a smaller diameter in the core thereof;
- the application head is an element made from a plastic comprising magnetizable ferrous matter;
- the magnetizable material is a galvanized steel or a magnetizable stainless steel;
- the cavity comprises one or more raised elements creating the visible depth of the cavity, said device being arranged so that the application head can roll on the raised elements in the cavity;
- the holder is surrounded by an enclosure;
- the holder comprises at least one boss configured to be blocked in a complementary cavity on the enclosure;
- the holder or the enclosure comprises a gripping portion;
- the raised elements are formed by bosses made in the holder or the enclosure;
- the raised elements are formed by one or more movably mounted rolling balls freely rotating in the holder;
- the cavity comprises three raised elements positioned in a same plane and distributed at an angle substantially equal to 120° relative to one another;
- the rolling ball(s) are mounted freely translating so as to vary the visible depth of the cavity;
- the rolling ball(s) are mounted freely translating by means of an attached part mounted on a magnet and configured to translate in the recess of the magnet;
- a ring is configured to rotate around the holder so as to translate the attached part in the recess;
- the holder is made up of an upper portion configured to form the cavity and one or more lower portion(s);
- a protruding element supported by part of the holder fits in a complementary cavity provided in another portion of the holder defining the cavity;
- the holder is configured to be mounted on the head of a receptacle intended to contain the fluid;
- the head comprises a cannula and the holder comprises a substantially peripheral shank configured to block the wall of the cannula;
- the head comprises a cannula and the holder comprises a recess configured to receive the cannula of the head, said recess having beveled corners configured to rest on the cannula;
- the fluid is a cosmetic or dermatological fluid;
- the device according to the invention comprises a vibrating means positioned and arranged to vibrate the application head.

According to another aspect, the invention relates to a device for storing and distributing a fluid comprising the application device according to the invention and a receptacle configured to contain the fluid.

Preferably, the receptacle is a tube, a bottle, or a bag.

The invention also relates to a use of the application device according to the invention or the device for storing and distributing a fluid according to the invention as a massage device on at least one part of the face and/or body.

BRIEF DESCRIPTION OF THE DRAWINGS

The invention will be better understood upon reading the following non-limiting description, done in reference to the appended figures.

DETAILED DESCRIPTION

Figure 1:
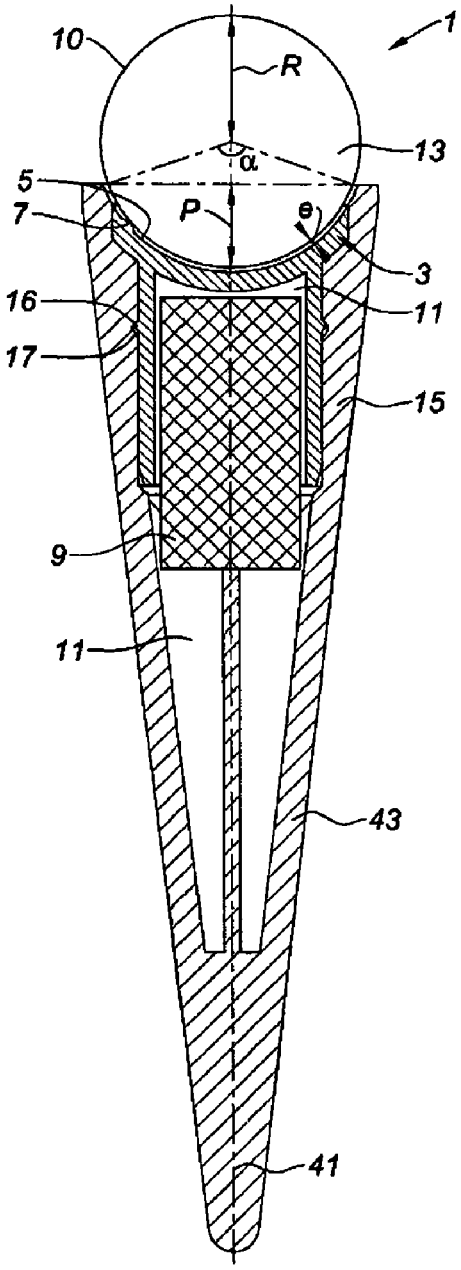
FIG. 1 is a transverse cross-section of one embodiment of the application device according to the invention.
Figure 2:
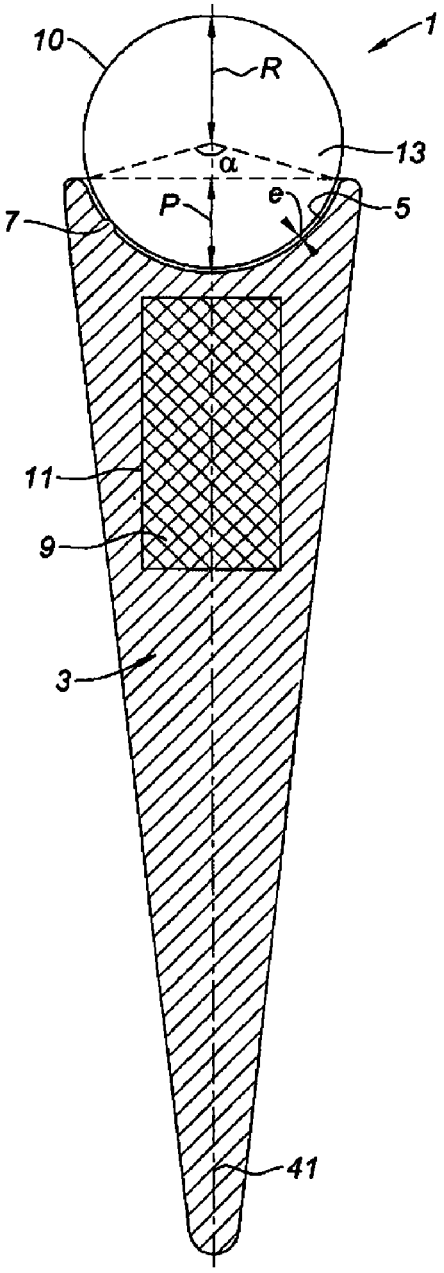
FIG. 2 is a transverse cross-section of one alternative of the embodiment of FIG. 1.
Figure 3:
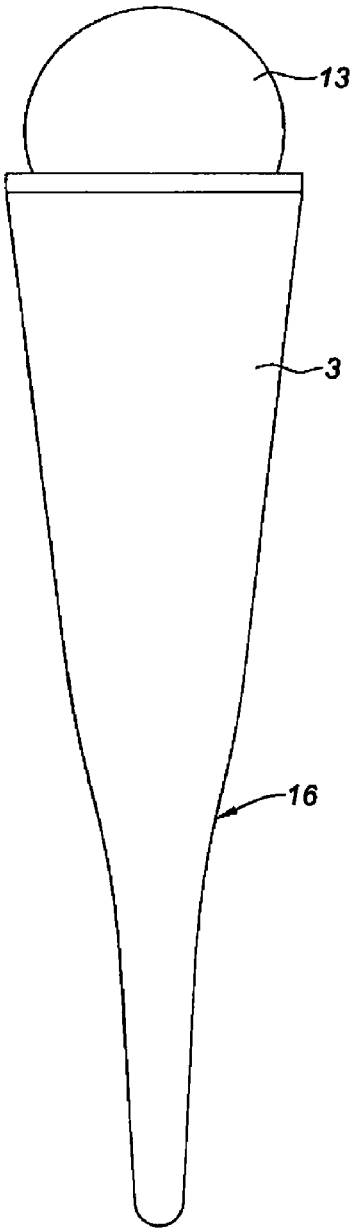
FIG. 3 is a front view of the embodiment of FIG. 2.

As illustrated in FIGS. 1 to 3, the fluid application device 1 includes:

- a holder 3 including a cavity 5 having a visible depth p;
- at least one magnet 9 contained in a recess 11 present in the holder 3;
- an application head including at least one portion made from a magnetizable material configured to be attracted by the magnet(s) 9, said application head having an application surface of more than half of the total outer surface of said head,
- the device 1 being arranged so that said application head is rotatably mobile within the cavity 5.

In the application device according to the invention 1, the application head is retained only by the magnetic force exerted by the magnet(s) 9 on said head. The different elements making up the application device according to the invention 1 do not serve to retain the application head in the cavity 5. There are therefore arranged to allow a large application surface 10 that is greater than half of the total outer surface of said head. In other words, the majority of the surface of the application head can be configured to be used to apply the fluid, in particular on the user's skin.

The application surface of the application head corresponds to the outer surface of the application head not opposite the holder 3. In this way, the application surface is in contact with the user's skin to potentially deposit the fluid thereon.

The device 1 according to the invention is arranged so as to allow better rotation of the application head in the cavity, and therefore better use of said device 1.

Furthermore, due to this large application surface 10, a user can easily grasp the application head to remove it from the cavity 5. The user can therefore simply and reproducibly remove the application head outside the application device according to the invention 1 to clean or change it, for example.

The application head can be at least one cylinder with a circular transverse section, and/or at least one element of revolution with a substantially oblong or circular shape, such as a substantially spherical ball. In the case of an application head including a plurality of cylinders and/or elements of revolution, one or more of said cylinders and/or one or more of said elements of revolution can be applied directly on the skin in order to massage the area of the skin with which they are in contact. In parallel, the other cylinders and/or the other elements of revolution can be intended to apply a fluid on the skin.

Each cylinder and each element of revolution with a circular transverse section, in particular each ball, typically have a radius larger than the visible depth of the cavity.

In the case of a ball, the application surface is formed by a portion of the ball whereof the apical angle can in particular be greater than 180°, in particular between 200° and 250°, or even substantially equal to 220°. In other words, the surface of the ball housed in the cavity and therefore opposite the holder corresponds to the surface of a cone with an apical angle $\alpha$ strictly smaller than 180°, in particular between 110° and 160°. In the case of a cylinder or an element of revolution with a substantially circular transverse section, the angle used is the angle at the center of each transverse section, said angle assuming the same values as the apical angle previously mentioned.

In the case of FIGS. 1 to 11, the application head assumes the form of a ball 13, but may assume another shape as mentioned above.

The application head(s) used to apply the fluid and/or directly on the user's skin may have a smooth and polished finish, or may have a textured appearance to impart various sensations during the massage and/or application.

The fluid distributed by the application device according to the invention 1 may be a cosmetic or dermatological fluid. The viscosity of the fluid is adapted so that said fluid can spread on the surface of the ball 13. In this way, the fluid may assume the form of a gel or cream. As a result, the application of said fluid is done on a user's skin, such as the face, neck, or any other part of the body.

As illustrated in FIGS. 1 to 3, the application device according to the invention 1 may assume the form of a means for distributing the fluid without containing or storing it, such as a spatula.

In this case, as illustrated in FIGS. 1 and 3, the holder 3 may be topped by an enclosure 15 including a gripping portion. The enclosure 15 may thus be made from a material capable of holding by welding, adhesion, turning over, or clipping on the holder 3. The material may for example be plastic, metal, or wood. As illustrated in FIG. 1, the holder 3 may comprise at least one boss 16 configured to be blocked in a complementary cavity 17 on the enclosure 15 so as to prevent the enclosure 15 from sliding on the holder 3.

In an alternative illustrated in FIG. 2, the holder 3 may be configured so as to form the gripping portion.

The holder 3 may be made up of one single-unit piece (see FIG. 2), or, on the contrary, of a multitude of parts fitting together.

As a result, the holder 3 or the enclosure 15 has a substantially conical shape, potentially with one or more concavities 16 (see FIG. 3) or with a non-slip coating so that the fingers or hand of a user can grip said portion.

As illustrated in FIGS. 4 to 9, the application device according to the invention 1 may be integrated into a device for storing and distributing the fluid, which then comprises a receptacle 21 configured to contain the fluid. In that case, the holder 3 can be configured to be mounted on the head 23 of a receptacle 21 arranged to contain the fluid.

The receptacle 21 may assume any shape, in particular a tube, a bottle, or a bag. The receptacle 21 may be made from any type of material, for example, glass, plastic, or aluminum.

The application device 1 according to the invention is configured so that the ball 13 can be rotatably mobile in the cavity 5. According to one embodiment, the ball 13 may be substantially in contact with the bottom of the cavity 5. To that end, the fluid is chosen so as to have a suitable viscosity to be able to spread on the surface of the ball 13 opposite the cavity 5 like a lubricant, i.e. between the surface of the ball 13 and that of the bottom of the cavity 5.

According to one alternative illustrated in FIGS. 1 to 11, the cavity 5 can comprise one or more raised elements 7 creating the visible depth p of the cavity 5, the device 1 being arranged so that the ball 13 can roll on the raised elements 7 in the cavity 5. As a result, the raised element(s) guarantee a spacing e between the surface of the ball 13 opposite the cavity 5 and that of said cavity.

The raised element(s) 7 are then configured so as to allow a spacing e so that the fluid can flow between the ball 13 and the walls of the cavity 5. The spacing e corresponds to the maximum height of the raised elements 7 relative to the wall of the cavity 5. The spacing e may have a height comprised between 0.1 mm and 1 mm, in particular substantially equal to 0.4 mm.

Figure 7:
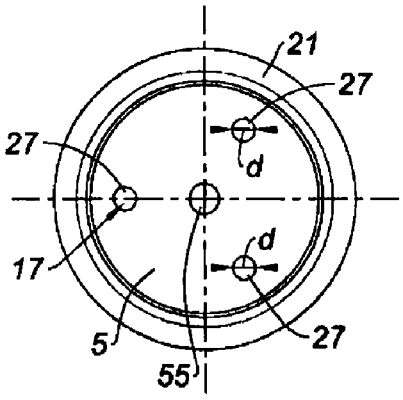
FIG. 7 is a top view of the recess of the application device of the invention of FIG. 6.

The cavity 5 may in particular comprise three raised elements 7 arranged in a same plane and distributed at an angle substantially equal to 120° relative to one another, which makes it possible to have the desired spacing e while ensuring a stable base for the ball 13 in the cavity 5 and therefore free rolling of the ball 13 without friction on the entire concave surface of the cavity 5. As illustrated in FIG. 7, the raised elements 7 in this embodiment form, on the wall of the cavity 5, a substantially equilateral triangle when said cavity 5 is seen from the front.

The raised elements 7 can be integral with the holder 3 (see FIG. 4) or can be attached thereon (see FIG. 5), in particular by means of an enclosure 25. The enclosure 25 can thus be made from metal or plastic, for example.

Figure 4:
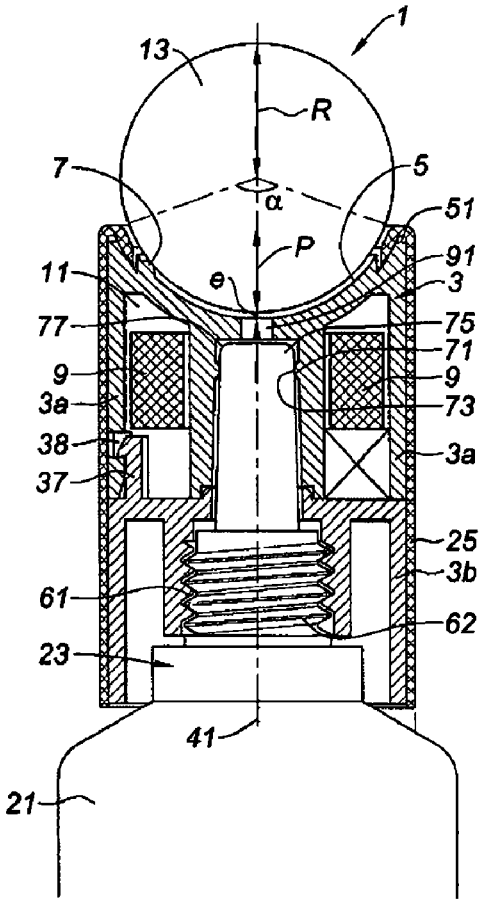
FIG. 4 is a transverse cross-section of a storage and distribution device according to the invention including one embodiment of the application device of the invention.
Figure 5:
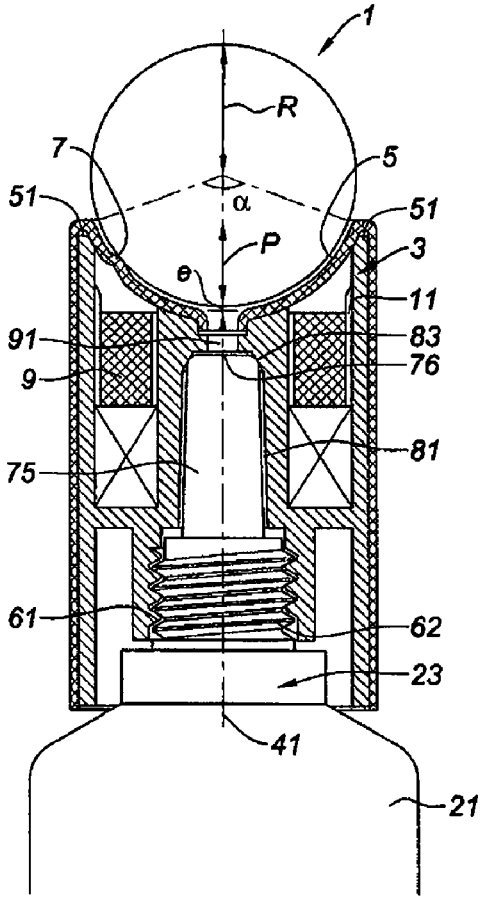
FIG. 5 is a transverse cross-section of a storage and distribution device according to the invention including another embodiment of the application device of the invention.

According to these embodiments, the raised elements 7 can be formed by bosses made in the walls of the cavity 5 (see FIG. 4) or by bosses made in said enclosure 25 (see FIG. 5).

According to one alternative illustrated in FIGS. 6 to 11, the raised elements 7 can be formed by one or more movable rolling balls 27 mounted freely rotating, or rolling, in the holder 3, in particular in one or more cavities 28 of the holder. To that end, said cavities 28 can be formed directly in the holder 3. The bottom of the cavity or cavities 28 can be formed by one or more attached elements 29 and 39 in the holder 3 (see FIG. 6 and FIGS. 8 to 11, respectively).

Figure 6:
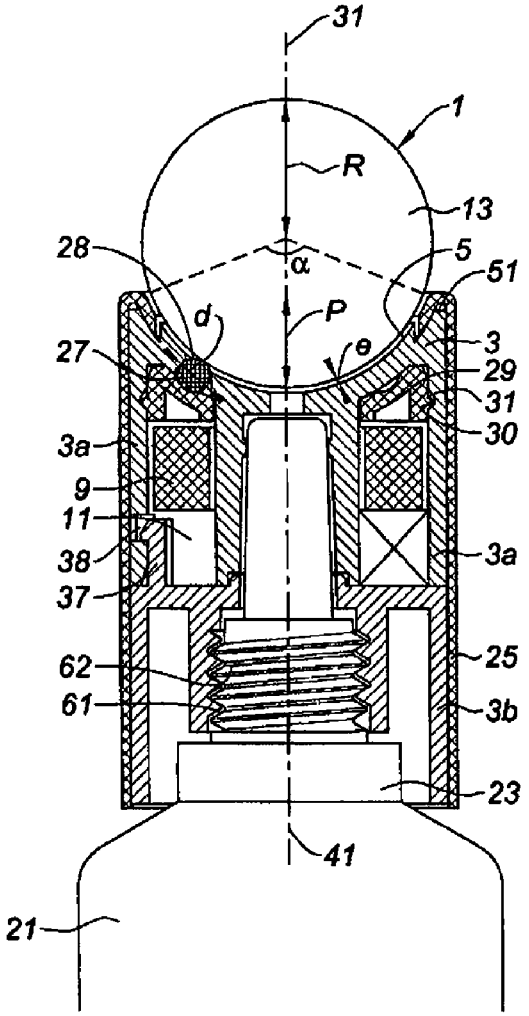
FIG. 6 is a transverse cross-section of a storage and distribution device according to the invention including another alternative of the application device of the invention.

According to one embodiment illustrated in FIG. 6, said elements 29 can comprise at least one boss 30 of the periodic type configured to come into a corresponding cavity 31 of the holder 3 so as to block the elements 29 in the holder 3.

In an alternative illustrated in FIGS. 8 to 11, the rolling ball(s) 27 are mounted freely translating, in particular along the central axis 41, so as to vary the visible depth p of the cavity 5. In this way, the rolling ball(s) 27 can each be mounted on an attached part 39 mounted on a magnet 9. The attached part 39 is mounted freely translating in the recess 11 receiving the magnet 9. As a result, the rolling ball(s) 27 can move up or down in the recess 11 so as to vary the visible depth p of the cavity, i.e. to provide a spacing e between the ball 13 and the cavity 5 that can be adjusted between a maximum spacing and a substantially nonexistent spacing in which the ball 13 can rest in the bottom of the cavity 5 and ensure sealing. The attached part 39 can translate over a length in particular between 0 mm and 2 mm, in particular equal to 0.5 mm.

The rolling ball(s) 27 can have a diameter d smaller than or equal to 4 mm.

The rolling ball(s) 27 can all have an identical diameter d or different diameters.

The rolling ball(s) 27 can be made from a metal or plastic material, which may or may not be magnetizable. Examples of plastics include polypropylene or polyoxymethylene (POM). Examples of metal materials include polished stainless steel not requiring galvanization, or galvanized steel. Said steel can be galvanized in particular using palladium as the finishing surface layer. The outer galvanization layer is typically made without nickel so as to avoid allergy risks.

The sealing can be done by an outer yoke which, at the end of screwing, can press the ball 13 against the bottom of the cavity 5 while making it possible to cover said cavity 5.

To that end, the rolling ball(s) 27 can each be mounted on a spring or on a spring plate of the POM type and are compressed. Each rolling ball 27 can be associated with one or more substantially hollow holders, which allows greater flexibility.

The rolling ball(s) 27 can be replaced by one or more substantially openwork pads, so as to ensure greater flexibility. The pads can be in a single piece with the holder 3, which supports the application head.

An opening and closing system using translation along the axis of the device 1 of the invention can be used. A ring or a click can make it possible to activate said system.

The cavity 5 typically has a shape substantially complementary to part of the ball 13. As a result, the cavity 5 is substantially in the shape of a half-shell.

The visible depth p typically corresponds to the actual depth of the cavity 5 minus the spacing e created by the raised elements 7, in the embodiment including such elements 7.

In the case where the ball 13 is substantially in contact with the bottom of the cavity 5, the visible depth p corresponds to the actual depth of the recess 5.

The radius R of the ball 13 is typically comprised between 3 mm and 20 mm, in particular substantially equal to 6.35 mm.

At least part of the ball 13 is made from a magnetizable material configured to be retained by the magnet(s) 90 owing to a magnetic force. According to one alternative in particular illustrated in FIGS. 10 and 11, the entire ball 13 is made from said magnetizable material.

The magnetizable material is, for example, a galvanized steel. During the galvanization, nickel is not used as the outer layer to avoid allergic reactions. Palladium may be used as the finishing or surface layer of the ball 13 to guarantee good compatibility with the fluid used, in particular a cosmetic or dermatological fluid. Typically, the deposited layer of palladium may have a thickness substantially equal to 0.35 μm.

The application head, in particular the ball 13, may be solid or hollow.

A solid application head, in particular the ball, may be made from any type of magnetizable metal or alloy, such as steel with or without a galvanization coating or a magnetizable stainless steel, such as, for example, steel 420, 430, 440, JFE443CT or JYH21CT. It is also possible for the solid application head, in particular the ball, to comprise a portion made from a plastic material, in particular a plastic overmolded with one or more magnetizable elements. The plastic element [sic] The application head, in particular the ball, may also assume the form of two half-elements, in particular two half-spheres, containing one or more elements made from a magnetizable material.

In order to decrease the weight of the application head, the application head, in particular the ball, may be hollow, and may be made by assembling one or more elements. Said elements may assume the form of two half-elements, in particular two half-spheres, adhered, forcibly set, or welded. The material used may be any magnetizable material such as a galvanized or non-galvanized steel, or a magnetizable stainless steel, such as, for example, steel 420, 430, 440, or JFE443CT, whether or not it is galvanized.

In the case of a hollow application head, in particular a ball, made from non-magnetizable stainless steel, such as for example steel 304 or 316, the latter may contain one or more magnetizable ferrous elements. In this way, the hollow application head, in particular the hollow ball, may be made in the form of two half-elements, in particular two half-spheres, made from anodized aluminum containing one or more freely moving magnetizable elements in the center thereof.

In this way, the application head may assume the form of a plastic or metal shell, in particular made from aluminum, containing a smaller metal element in the core thereof. Using an aluminum shell allows easy anodizing and dyeing.

The application head may be an element made from a plastic comprising magnetizable ferrous matter. Examples of plastics include polypropylene (PP) enriched with ferrous particles.

Figure 8:
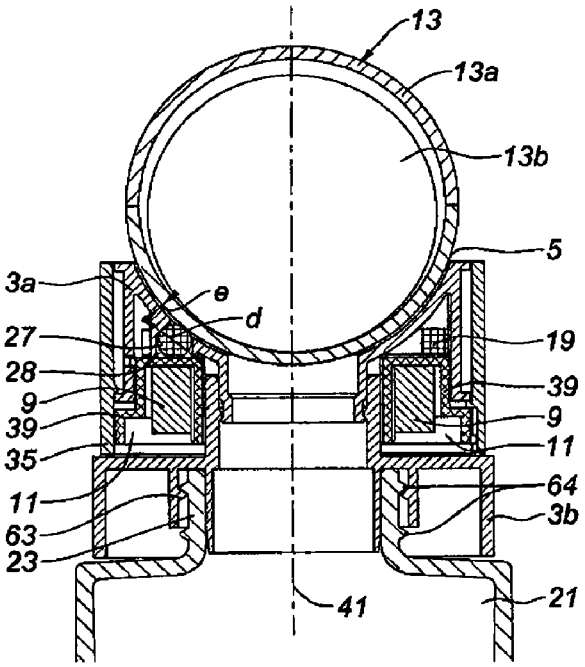
FIGS. 8 and 9 are transverse cross-sections of one alternative of the application device according to the invention, in the open and closed positions, respectively.
Figure 9:
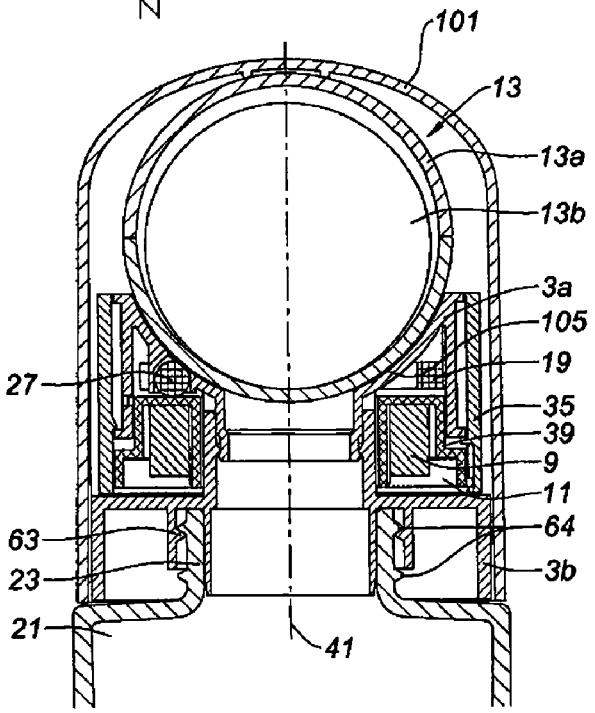

According to the alternative illustrated in FIGS. 8 and 9, the ball 13 made thus assume the form of a plastic ball 13*a* containing a metal ball 13*b* with a small diameter in the core thereof. The plastic ball 13*a* may assume the form of a plastic double shell, in particular welded together.

The ball 13 may have a substantially smooth surface, or, on the contrary, a textured surface. "Textured" refers to a ball 13 having reliefs or irregularities on the surface, or matte or satinized finishes.

As indicated above, at least one magnet 9 is used to retain the ball 13. In particular, the application device according to the invention 1 can comprise one or more magnets 9 that are substantially cylindrical (see FIGS. 1 and 2) or toroidal (see FIGS. 4 to 6). In one alternative illustrated in FIGS. 8 to 11, the application device according to the invention 1 can comprise additional magnets 19 with an annular or toroidal section.

The magnet(s) 9 can be positioned in the holder 3 so as to have a uniform magnetic attraction on the ball 13 and therefore allow uniform maintenance thereof. To that end, the magnet(s) 9 are mounted in the holder substantially symmetrically relative to the central axis 41 of the application device according to the invention 1 passing through the center of the ball 13.

According to the alternative illustrated in FIGS. 8 to 11, the application device according to the invention 1 can comprise a multitude of magnets 9 and 19, in particular of different sizes. In this way, the application device according to the invention 1 may comprise three or more magnets that are arranged as a function of the desired distribution of the magnetic force created by the magnets 9 and 19.

The holder 3 may be made up of one single unit (see FIGS. 2 and 5), or on the contrary of at least two units, also called "portions" (see FIGS. 1, 4, 6 and 7). The upper portion 3*a* of the holder 3 making up the cavity 5 is typically made in a single piece so as to simplify the manufacture of the application device according to the invention 1. The holder 3 may comprise one or more lower portions 3*b* intended to be mounted on the head 23 of a receptacle containing the fluid.

Typically, the holder 3 may be made from a plastic, such as polypropylene. The portions 3*a* and 3*b* forming the holder 3 can be made from a same material or from different materials.

As illustrated in FIGS. 4 and 6, in the event the holder 3 is made up of two upper 3*a* and lower 3*b* portions, said portions 3*a* and 3*b* can be assembled using clipping means preventing the two upper 3*a* and lower 3*b* portions from rotating relative to one another. In this way, the clipping means may comprise a protruding element 37 supported by the lower portion 3*b* coming into a complementary cavity 38 provided in the upper portion 3*a* defining the cavity 5. It is also possible for the protruding element 37 to be supported by the upper portion 3*a* and the cavity 38 by the lower portion 3*b*.

The holder 3 may be solid or made up of a multitude of recesses, some 11 of which may contain the magnet(s) 9 and 19.

The holder 3 may be topped by an enclosure 25 so as to protect said holder 3 and also avoid right angles 51, which cause discomfort for the user during application of the fluid. To that end, the enclosure 25 may be made from aluminum.

In one alternative not shown, the holder 3 may comprise at least one boss configured to be blocked in a complementary cavity on the enclosure 25 so as to prevent the enclosure 25 from sliding on the holder 3.

As indicated above, the enclosure 25 can support the raised elements 7.

Typically, the holder 3 comprises at least one opening 55 making it possible to convey the fluid outside the head 23 of the receptacle.

The holder 3 may comprise retaining means configured to cooperate with the head 23 of the receptacle to keep the latter in position during application of the fluid by a screwing or snapping system. In particular, as illustrated in FIGS. 4 to 6, the holder 3 may comprise a screw pitch 61 configured to cooperate with a screw pitch 62 on the head 23 of the receptacle. According to one alternative, the retaining means may include a protruding element 63 configured to cooperate with the thread 64 of the head of the receptacle allowing snapping by quarter revolutions, for example (see FIGS. 8 and 9).

As shown in FIGS. 4 and 6, the holder 3 comprises a substantially peripheral shank 71 configured to be blocked on the side wall 73 of a cannula 75 of the head so as to ensure sealing. The cannula 75 is housed in a recess 77 provided in the holder 3. Said cannula 75 can comprise one or more openings 76 through which the fluid can flow, which are positioned at the free end of the cannula 75.

According to one alternative shown in FIG. 5, the holder 3 may comprise a cannula recess 81 having beveled corners 83 configured to rest on the free end of the cannula 75 so as to ensure sealing.

The holder 3 can comprise a central opening 91 making it possible to bring the fluid toward the ball. Said opening 91 can substantially coincide with an opening of the head 23 of the receptacle or with a channel collecting the fluid coming from the head 23 of the receptacle.

The application device according to the invention can also comprise a cap configured to close said device after use. The cap can be retained on the support or on the enclosure using any means known by those skilled in the art, in particular by screwing, clipping, or friction. The cap may typically be made from a cyclohexanedimethanol and purified terephthalic acid (PTA) copolyester or polypropylene (PP). According to one alternative, a cap comprising a protuberance can be housed in the opening of the cannula 75 so as to guarantee sealing after use. According to this alternative, the ball 13 is removed from the cavity 13 beforehand.

Figure 10:
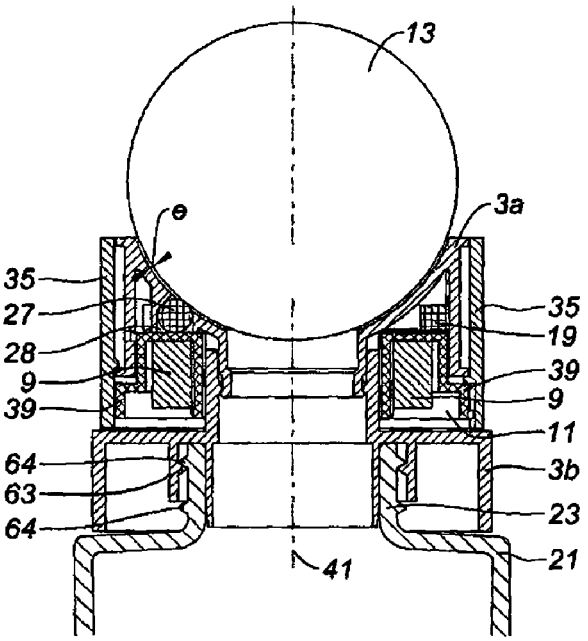
FIGS. 10 and 11 are transverse cross-sections of one alternative of the application device according to the invention, in the open and closed positions, respectively.
Figure 11:
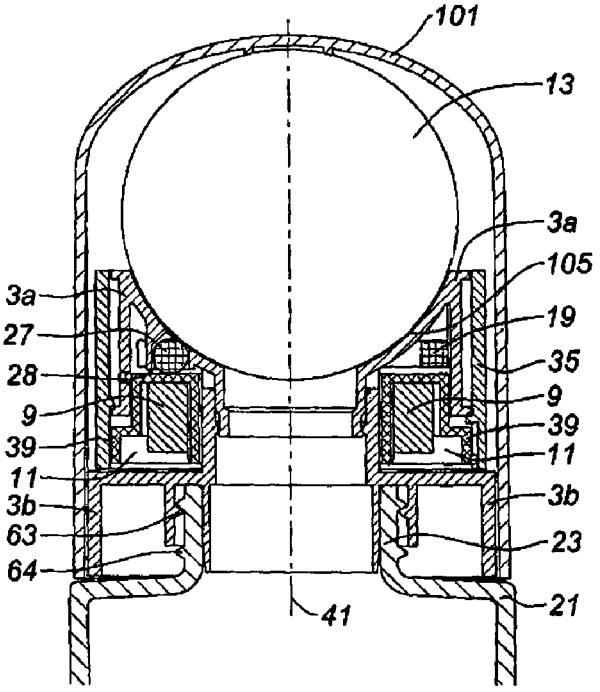

Thus in the embodiments illustrated in FIGS. 9 and 11, the cap 101 is kept on the application device of the invention 1 by friction, in particular on a stationary part of the application device 1 according to the invention. In these embodiments illustrated in FIGS. 8 to 11, at least part of the magnets 9 are topped by the attached part 39, which supports a rolling ball 27, which ensures sufficient spacing e to allow the fluid to flow on the surface of the ball 13. A ring-type enclosure 35 is configured to rotate around the longitudinal axis 41 of the application device according to the invention. More specifically, the rotation of the enclosure 35 is done around the holder 3, in particular around the upper portion 3*a* thereof. Such rotation makes it possible to translate the attached part 39 so that the rolling ball 27 moves away from the ball 13 to come into the closing position, as illustrated in FIGS. 9 to 11. As a result, the ball 13 attracted by the magnets 9 is housed in the cavity 5. Another part configured to rotate around the center 41, and which may or may not belong to the holder 3, can be used to ensure the movement of the attached part 39.

In order to guarantee sealing, the cavity 5 can comprise a flat section 105 at the bottom thereof preventing the fluid from flowing around the ball 13.

Once the cap 101 is mounted on the application device according to the invention 1, it can help mechanically press the ball 13 in the bottom of the cavity.

The device 1 according to the invention may contain a vibrating means positioned and arranged so as to vibrate the application head. The vibrating means may be one or more motors.

The device 1 according to the invention as well as the device for storing and distributing the fluid can also each be used as a massage device intended to be used on at least part of the skin of the face and/or body. Advantageously, such a massage device makes it possible not to pinch the skin, which ensures comfortable use.

Of course, the features described in the context of the embodiments described above may be considered alone or combined with one another without going beyond the scope of the present invention. In particular, the features described relative to a ball as application head may also be transposed in the case of an application head having a non-spherical shape.

The invention claimed is:

1. A device for storing and distributing a fluid, the device comprising a receptacle configured to contain the fluid and a fluid application device mounted on the receptacle, the fluid application device including:

a holder including a cavity that has a visible depth for the cavity, the cavity being provided with at least one opening for conveying the fluid outside the receptacle;

at least one magnet contained within an internal recess that is present inside the holder, behind the cavity;

an application head including at least one portion made of a magnetizable material that is formed so as to be attracted by the at least one magnet, said application head having a fluid application surface that is greater than half a total outer surface of said application head, the fluid application surface of the application head corresponding to an outer surface of the application head not opposite the holder so that a majority of the fluid application surface of the application head is configured to apply the fluid, wherein the device is configured such that said application head is rotatably movable within the cavity, and wherein the cavity comprises one or more raised elements creating the visible depth of the cavity, said device being arranged so that the application head rolls on the one or more raised elements in the cavity.

2. The device according to claim 1, wherein the application head is at least one cylinder with a circular transverse section, and/or at least one element of revolution with a substantially oblong or circular shape.

3. The device according to claim 1, wherein the application head is a ball having a radius larger than the visible depth of the cavity.

4. The device according to claim 1, wherein the application head is solid or hollow.

5. The device according to claim 1, wherein the application head assumes a form of a plastic or metal shell made from aluminum, containing a smaller metal element in a core thereof.

6. The device according to the claim 1, wherein the application head is a ball in a form of a plastic hall containing a magnetizable metal ball with a smaller diameter in a core thereof.

7. The device according to claim 1, wherein the application head is an element made from a plastic and comprising magnetizable ferrous matter.

8. The device according to claim 1, wherein the magnetizable material is a galvanized steel or a magnetizable stainless steel.

9. The device according to claim 1, wherein the holder is surrounded by an enclosure.

10. The device according to the claim 9, wherein the holder comprises at least one boss configured to be blocked in a complementary cavity on the enclosure.

11. The device according to claim 10, wherein the holder or the enclosure comprises a gripping portion.

12. The device according to claim 9, wherein the one or more raised elements are formed by bosses made in the enclosure.

13. The device according to claim 1, wherein the one or more raised elements are formed by one or more movably mounted rolling balls freely rotating in the holder.

14. The device according to claim 1, wherein the cavity comprises three raised elements positioned in a same plane and distributed at an angle substantially equal to 120' relative to one another.

15. The device according to claim 13, wherein the one or more movably mounted rolling balls are mounted freely translating so as to vary the visible depth of the cavity.

16. The device according to claim 13, wherein the one or more movably mounted rolling balls are mounted freely translating by means of an attached part mounted on the at least one magnet and configured to translate in the internal recess containing the at least one magnet.

17. The device according to claim 16, further comprising a ring-shaped enclosure configured to rotate around the holder so as to translate the attached part in the recess containing the at least one magnet.

18. The device according to claim 1, wherein the holder is made up of an upper portion configured to form the cavity and one or more lower portions.

19. The device according to claim 1, wherein a protruding element supported by a portion of the holder fits in a complementary cavity provided in another portion of the holder defining the cavity.

20. The device according to claim 1, wherein the holder is configured to be mounted on a head of the receptacle intended to contain the fluid.

21. The device according to claim 20, wherein the head of the receptacle comprises a cannula and the holder comprises a substantially peripheral shank configured to block a wall of the cannula.

22. The device according to claim 20, wherein the head of the receptacle comprises a cannula and the holder comprises a recess configured to receive the cannula of the head, said recess having beveled corners configured to rest on the cannula.

23. The device according to claim 1, comprising a vibrator positioned and arranged to vibrate the application head.

24. The device according to claim 1, wherein the receptacle is a tube, a bottle, or a bag.

25. The device according to claim 1, wherein the device is configured as a massage device for use on at least one part of a face and/or body.

26. The device according to claim 1, wherein the holder is made from plastic.

27. The device according to claim 1, wherein the one or more raised elements are formed by bosses made in the holder.

* * * * *